US006000504A

United States Patent [19]

Koh et al.

[11] Patent Number: 6,000,504

[45] Date of Patent: Dec. 14, 1999

[54] GROUP MANAGEMENT CONTROL METHOD FOR ELEVATOR

[75] Inventors: Eung-Lyeol Koh, Inchon; Jeong-O Kim, Kyungsangnam-Do; Pai Hun Hahn, Seoul, all of Rep. of Korea

[73] Assignee: LG Industrial Systems Co., Ltd., Seoul, Rep. of Korea

[21] Appl. No.: 09/001,015

[22] Filed: Dec. 30, 1997

[30] Foreign Application Priority Data

Dec. 30, 1996 [KR] Rep. of Korea ..... 96-77557

[51] Int. Cl.[6] ..... B66B 1/18

[52] U.S. Cl. ..... 187/382; 187/380; 706/910; 706/13

[58] Field of Search ..... 187/380, 382, 187/383; 706/910, 13

[56] References Cited

U.S. PATENT DOCUMENTS 5,612,519 3/1997 Chenais ..... 187/382

5,679,932 10/1997 Kim ..... 187/382

5,780,789 7/1998 Tsuji ..... 187/380

FOREIGN PATENT DOCUMENTS 5-319707 12/1993 Japan .

*Primary Examiner*—Robert E. Nappi

[57] ABSTRACT

The present invention relates to servicing a car to a hall call in a group management system which controls a plurality of elevators installed in a building. A group management control method for an elevator according to the present invention is capable of decreasing an average waiting time and a waiting generation probability by selecting more than two cars having high evaluation values after evaluating each car using a synthetic evaluation function, and allocating one car which is regarded as an optimum car for servicing by applying a genetic algorithm which is known to be highly efficient in a system with a large search space.

20 Claims, 19 Drawing Sheets

FIG.2
CONVENTIONAL ART

| FLOOR NO. | UPWARD ESTIMATE PROBABILITY | HALL CALL WHICH IS NOT ALLOCATED | # 1 | # 2 | # 3 | # 4 |
|---|---|---|---|---|---|---|
| 19 | | | | o | | |
| 18 | 0.2 | | o | | | ↓ |
| 17 | 0.3 | △ | | | | |
| 16 | | | | | | |
| 15 | 0.5 | | | | | |
| 14 | 0.3 | | | | ↓ | |
| 13 | 0.7 | | | | | |
| 12 | 0.6 | | | | | |
| 11 | 0.8 | | | | | |
| 10 | 0.4 | | | | | |
| 9 | 0.5 | | | | | |
| 8 | 0.2 | | | ↑ | | |
| 7 | 0.2 | | | | | |
| 6 | 0.1 | | | | ▽ | |
| 5 | 0.1 | | | | | |
| 4 | 0.2 | | | | | |
| 3 | 0.4 | | | | | |
| 2 | 0.5 | | ↑ | | | |
| 1 | 0.7 | | | | | o |

SECTION 1

SECTION 2 o :CAR CALL

▽ :HALL CALL OF DOWNWARD DIRECTION

△ :HALL CALL OF UPWARD DIRECTION

△ :HALL CALL WHICH IS NOT ALLOCATED

↓ :DESCENDING CAR

↑ :ASCENDING CAR

FIG.6

| SOLUTION (INDIVIDUAL) | EVALUATION VALUE |
|---|---|
| NO.1 (010101) | 6 |
| NO.2 (111111) | 3 |
| NO.3 (111000) | 9 |
| NO.4 (000011) | 12 |
| NO.5 (000000) | 1 |

FIG.7

| SOLUTION (INDIVIDUAL) | PARENT SELECTION PROBABILITY |
|---|---|
| NO.1 | 6/(6+3+9+12+1)=0.19 |
| NO.2 | 3/(6+3+9+12+1)=0.1 |
| NO.3 | 9/(6+3+9+12+1)=0.3 |
| NO.4 | 12/(6+3+9+12+1)=0.39 |
| NO.5 | 1/(6+3+9+12+1)=0.03 |

FIG. 10

| FLOOR | UP | DOWN | CALL | # 1 | # 2 | # 3 | # 4 |
|---|---|---|---|---|---|---|---|
| 12 | 0.0 | 0.3 | | | ○ | ▯ | |
| 11 | 0.2 | 0.7 | | ○ | | | |
| 10 | 0.1 | 0.8 | | | | | |
| 9 | 1.0 | 0.7 | | | △ | | |
| 8 | 0.8 | 0.1 | | | | | ↓ |
| 7 | 0.5 | 0.6 | | | | | |
| 6 | 0.4 | 0.3 | | | | | |
| 5 | 0.1 | 1.0 | | | ↑ | | ▽ |
| 4 | 0.2 | 0.1 | | | | | |
| 3 | 0.1 | 0.3 | | | | | |
| 2 | 0.3 | 0.4 | | ↑ | | | |
| 1 | 1.0 | 0.0 | △ | | | | |

○ : CAR CALL

▽ : HALL CALL OF DOWNWARD DIRECTION

△ : HALL CALL OF UPWARD DIRECTION

△ : HALL CALL WHICH IS NOT ALLOCATED

↓ : DESCENDING CAR

↑ : ASCENDING CAR

▯ : STOPPING CAR

FIG. 11

| | UPWARD | | |

FIG. 13

| HALL CALL (DAWNWARD) | 7th FLOOR | 5th FLOOR | 3th FLOOR | 2th FLOOR | GENERATION PROBABILITY OF EACH CASE | EXPECTATION OF EACH CASE |
|---|---|---|---|---|---|---|
| GENERATION PROBABILITY | 0.6 | 1.0 | 0.3 | 0.4 | | |
| CASE1 | T | T | T | T | 0.6*1.0*0.3*0.4=0.072 | 0.072*(14+40)=3.888 |
| CASE2 | T | T | T | F | 0.6*1.0*0.3*0.6=0.108 | 0.108*(14+30)=4.752 |
| CASE3 | T | T | F | T | 0.6*1.0*0.7*0.6=0.252 | 0.252*(14+30)=11.088 |
| CASE4 | T | T | F | F | 0.6*1.0*0.7*0.4=0.168 | 0.168*(14+20)=5.712 |
| CASE5 | F | T | T | T | 0.4*1.0*0.3*0.4=0.048 | 0.048*(14+30)=2.112 |
| CASE6 | F | T | T | F | 0.4*1.0*0.3*0.6=0.072 | 0.072*(14+20)=2.448 |
| CASE7 | F | T | F | T | 0.4*1.0*0.7*0.4=0.112 | 0.112*(14+20)=3.808 |
| CASE8 | F | T | F | F | 0.4*1.0*0.7*0.6=0.168 | 0.168*(14+10)=4.032 |

FIG. 15

| | UPWARD | | | | | | | | | | | | DOWNWARD | | | | | | | | | | | |
|---|---|---|---|---|---|---|---|---|---|---|---|---|---|---|---|---|---|---|---|---|---|---|---|---|
| FLOOR / CAR | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
| #1 | | ○ | | | ○ | | | | | | | | | | | | | ○ | | ○ | | | | ○ |
| #2 | | | | | | ○ | ○ | ○ | ○ | | | | | | | ○ | | | | | | | | |
| #3 | | | ○ | ○ | | | | | | ○ | ○ | | | | | | | | | | ○ | ○ | ○ | |
| #4 | ○ | | | | | | | | | | | | | ○ | ○ | | ○ | | ○ | | | | | |

FIG. 16

| SOLUTION (1st FLOOR UPWARD HALL CALL ALLOCATION CAR) | SUITABILITY | ALLOCATION PROBABILITY |
|---|---|---|
| 1st CAR | 10 | 0 |
| 2nd CAR | 20 | 20/(20+30+40)=0.22 |
| 3rd CAR | 30 | 30/(20+30+40)=0.33 |
| 4th CAR | 40 | 40/(20+30+40)=0.44 |

FIG. 17

| | UPWARD | | | | | | | | | | | | DOWNWARD | | | | | | | | | | | |
|---|---|---|---|---|---|---|---|---|---|---|---|---|---|---|---|---|---|---|---|---|---|---|---|---|
| FLOOR / INDIVIDUAL | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
| a | 2 | | | | | | | | | | | | | | | | | | | | | | | |
| b | 3 | | | | | | | | | | | | | | | | | | | | | | | |
| c | 4 | | | | | | | | | | | | | | | | | | | | | | | |
| d | 2 | | | | | | | | | | | | | | | | | | | | | | | |
| e | 4 | | | | | | | | | | | | | | | | | | | | | | | |
| f | 3 | | | | | | | | | | | | | | | | | | | | | | | |
| g | 4 | | | | | | | | | | | | | | | | | | | | | | | |
| h | 4 | | | | | | | | | | | | | | | | | | | | | | | |
| i | 4 | | | | | | | | | | | | | | | | | | | | | | | |
| j | 3 | | | | | | | | | | | | | | | | | | | | | | | |

FIG. 18

| | UPWARD | | | | | | | | | | | | DOWNWARD | | | | | | | | | | | |
|---|---|---|---|---|---|---|---|---|---|---|---|---|---|---|---|---|---|---|---|---|---|---|---|---|
| FLOOR / INDIVIDUAL | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
| a | 2 | | | | | | | | 2 | | 1 | 0 | 0 | | | | 4 | | | | | | | 3 |
| b | 3 | | | | | | | | 2 | | 1 | 0 | 0 | | | | 4 | | | | | | | 3 |
| c | 4 | | | | | | | | 2 | | 1 | 0 | 0 | | | | 4 | | | | | | | 3 |
| d | 2 | | | | | | | | 2 | | 1 | 0 | 0 | | | | 4 | | | | | | | 3 |
| e | 4 | | | | | | | | 2 | | 1 | 0 | 0 | | | | 4 | | | | | | | 3 |
| f | 3 | | | | | | | | 2 | | 1 | 0 | 0 | | | | 4 | | | | | | | 3 |
| g | 4 | | | | | | | | 2 | | 1 | 0 | 0 | | | | 4 | | | | | | | 3 |
| h | 4 | | | | | | | | 2 | | 1 | 0 | 0 | | | | 4 | | | | | | | 3 |
| i | 4 | | | | | | | | 2 | | 1 | 0 | 0 | | | | 4 | | | | | | | 3 |
| j | 3 | | | | | | | | 2 | | 1 | 0 | 0 | | | | 4 | | | | | | | 3 |

FIG. 19

| | UPWARD | | | | | | | | | | | | DOWNWARD | | | | | | | | | | | |
|---|---|---|---|---|---|---|---|---|---|---|---|---|---|---|---|---|---|---|---|---|---|---|---|---|
| FLOOR / CAR | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
| 1st CAR | 52 | 0 | 2 | 4 | 6 | 8 | 10 | 12 | 14 | 16 | 18 | | | 50 | 48 | 46 | 44 | 42 | 40 | 38 | 36 | 34 | 32 | 20 |
| 2nd CAR | 52 | 68 | 70 | 72 | 0 | 2 | 4 | 6 | 8 | 20 | 22 | | | 54 | 52 | 50 | 48 | 46 | 44 | 42 | 40 | 38 | 36 | 24 |
| 3rd CAR | | | | | | | | | | | | | | | | | | | | | | | | |
| 4th CAR | 24 | 36 | 38 | 40 | 42 | 44 | 46 | 48 | 50 | 52 | 54 | 56 | 24 | 22 | 20 | 18 | 6 | 4 | 2 | 62 | 64 | 66 | 68 | 70 |

unit: 1 second

FIG.20

| | UPWARD | | | | | | | | | | | | DOWNWARD | | | | | | | | | | | |
|---|---|---|---|---|---|---|---|---|---|---|---|---|---|---|---|---|---|---|---|---|---|---|---|---|
| FLOOR / INDIVIDUAL | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
| a | 2 | 3 | 3 | 1 | 1 | 1 | 3 | 2 | 2 | 2 | 1 | 0 | 0 | 3 | 1 | 4 | 4 | 4 | 2 | 2 | 2 | 3 | 3 | 3 |
| b | 3 | 3 | 3 | 4 | 4 | 4 | 1 | 2 | 2 | 2 | 1 | 0 | 0 | 3 | 3 | 4 | 4 | 4 | | | | 3 | 3 | 3 |
| c | 4 | 4 | 4 | 4 | 3 | 3 | 3 | 2 | 2 | 2 | 1 | 0 | 0 | 4 | 4 | 4 | 4 | 4 | 1 | 1 | 1 | 3 | 3 | 3 |
| d | 2 | 3 | 3 | 3 | 3 | 3 | 4 | 2 | 2 | 2 | 1 | 0 | 0 | 4 | 1 | 4 | 4 | 4 | 1 | 1 | 1 | 3 | 3 | 3 |
| e | 4 | 4 | 4 | 3 | 3 | 3 | 4 | 2 | 2 | 2 | 1 | 0 | 0 | 3 | 3 | 4 | 4 | 4 | 2 | 2 | 1 | 3 | 3 | 3 |
| f | 3 | 1 | 1 | 1 | 3 | 3 | 3 | 2 | 2 | 2 | 1 | 0 | 0 | 3 | 4 | 4 | 4 | 4 | 3 | 2 | 2 | 3 | 3 | 3 |
| g | 4 | 4 | 4 | 1 | 2 | 1 | 1 | 2 | 2 | 2 | 1 | 0 | 0 | 4 | 3 | 4 | 4 | 4 | 1 | 1 | 1 | 3 | 3 | 3 |
| h | 4 | 3 | 3 | 1 | 1 | 1 | 1 | 2 | 2 | 2 | 1 | 0 | 0 | 3 | 3 | 4 | 4 | 4 | 2 | 2 | 3 | 2 | 3 | 3 |
| i | 4 | 4 | 4 | 1 | 2 | 1 | 1 | 2 | 2 | 2 | 1 | 0 | 0 | 3 | 3 | 4 | 4 | 4 | 3 | 1 | 3 | 2 | 3 | 3 |
| j | 3 | 3 | 3 | 3 | 1 | 1 | 1 | 2 | 2 | 2 | 1 | 0 | 0 | 3 | 3 | 4 | 4 | 4 | 3 | 3 | 3 | 3 | 3 | 3 |

FIG.21

| GENE | a | b | c | d | e | f | g | h | i | j |
|---|---|---|---|---|---|---|---|---|---|---|
| EVALUATION VALUE | 1 | 3 | 5 | 7 | 9 | 2 | 3 | 5 | 10 | 15 |

GROUP MANAGEMENT CONTROL METHOD FOR ELEVATOR

BACKGROUND OF THE INVENTION

1. Field of the Invention

The present invention relates to an elevator, and in particular to an improved group management control method for an elevator capable of decreasing an average waiting time and a waiting generation probability by selecting and servicing an optimum car for a passenger, and an improved allocating method for a group management system of an elevator capable of performing allocation and control by considering a current hall call as well as a future hall call, by introducing a genetic algorithm which is known to be highly efficient in a system with a large search space to an allocation algorithm.

2. Description of the Conventional Art

When a call by a passenger is generated in a waiting floor group (hereinafter, called a hall call), a group management system of an elevator evaluates various situations regarding each car's location, operating speed, direction, open/close state of a car door, and a number of passengers, etc., thus allocating an optimum elevator car for a certain situation to the hall call, and servicing the allocated car to the hall call generating floor.

Such a group management system should satisfy various objects such as shortening a waiting time, decreasing an allocation failure probability, that is the elevator car passes without stopping at an allocated floor due to the full capacity of the car, decreasing congestion in the car, reducing a power consumption, etc. In order to achieve the above objects, on the basis of a floor to which a current state of each car and a hall call (a hall call to which an elevator for servicing is already determined) are already allocated, the group management system evaluates a newly generated hall call, and allocates an elevator car which is in an optimum condition for achieving the objects. However, since a transport demand varies momentarily, the group management system may be able to achieve the above objects when properly adapting to a change of the transport demand. Accordingly, the group management system should allocate the elevator car by considering the current hall call as well as a future hall call.

Since such a group management system has limitation in accomplishing a satisfying performance by a traditional controlling operation due to its complexity, an artificial intelligence method such as a fuzzy theory, an artificial neural network theory is introduced thereto.

FIG. 1 is a block diagram illustrating an allocating apparatus of a conventional group management system of an elevator. As shown therein the allocating apparatus of the conventional group management system of an elevator includes a hall button controller 11 for controlling a hall button installed at a passenger waiting floor, a car controller 12 for controlling an operation of an elevator car, and a group management control unit 13.

The group management control unit 13 includes: a information collecting unit 13A for collecting various information from the hall button controller 11 and the car controller 12; a statistics unit 13B for collecting statistics of the collected information; a transport kind characteristic discrimination unit 13C for comparing a current transport state to several predetermined transport kind patterns and selecting a corresponding one; an estimate transport kind generating unit 13F for generating an estimate transport kind; a statistics data base 13E for storing data related with various transport kinds by each class of a time, a date, and a transport kind; an estimate data generating unit 13G for generating various estimate data on the basis of the data stored in the estimate transport kind generating unit 13F and the statistics data base 13E; and an allocating/controlling unit 13D for allocating and controlling the elevator car based from the above information.

The operation of the thusly constructed group management system will be described with reference to FIG. 2 which illustrates an operating state of the elevator.

The information collecting unit 13A obtains data related to passenger information such as a number of embarking/disembarking person by each class of a floor and a direction by applying various sensors installed in each car, and receives a condition of each car (opening/closing of a door, a location of the car, a direction of the car, etc.) from the car controller 12.

The transport kind characteristic discrimination unit 13C compares predetermined characteristics of transport kinds or characteristics of the transport kinds stored in the statistics data base 13E to a current transport kind, and determines which transport kind corresponds to the current transport kind. On the basis of characteristics of the determined transport kind, the allocating/controlling unit 13D becomes able to control the elevator car storing a control algorithm suitable for characteristics of each transport kind.

The statistics unit 13B collects characteristics of current data received from the information collecting unit 13A and the transport kind characteristic discrimination unit 13C by each character of the time, the data, and the transport kind, and continuously renews data in the statistics data base 13E, thus enabling the group management system to properly correspond to the change of the transport kind.

The estimate transport kind generating unit 13F computes information (the number of embarking/disembarking passengers by each floor and direction) of a future transport kind on the basis of the data and the characteristics of the transport kind stored in the statistics data base 13E, and the current transport kind stored in the transport kind characteristic discrimination unit 13C.

The estimate data generating unit 13G generates various estimate data such as an estimate arrival time of the elevator car, an estimate number of passengers using the elevator car, an estimate car stopping probability, a floor at which a car call is generated on the way of a hall call service, etc. based from the future transport kind and the current state of the elevator car.

The allocating/controlling unit 13D allocates an elevator car on the basis of the current state of the elevator car, a current transport kind, and the estimate data, and performs various controlling operations such as a distributed control, an integrated service control, etc..

The operation of the conventional apparatus will now be described with reference to FIG. 2.

FIG. 2 illustrates various kinds of situations of a building where there are 19 floors and 4 elevator cars.

As shown therein, a hall call of an upward direction is newly generated on a 16th floor while each of the elevator cars is servicing a previously generated hall call, and first and second elevator cars are ascending, and third and fourth elevator cars are descending. In order to make a simple description, supposing that one of the first and second cars is allocated to the hall call on the 16th floor, an estimate hall call generation probability of the upward direction which may be generated at each floor will be shown as FIG. 2.

In the above-described situation, each estimate arrival time of the first and second cars with respect to a hall call at a the floor which is not allocated yet is obtained, thus allocating an elevator car of which an estimate arrival time is faster than the other. Here, the estimate arrival time f(t) can be obtained by the following equation:

f(t)=a time when an elevator car arrives at a hall call generating floor+W* (an estimate hall call generation probability of the upward direction * the time required for each stop of the elevator car)

wherein, W is a weighting factor for determining how many data of the estimate hall call should be used for allocating the elevator car. Here, suppose that W is 0.5.

When the time required for an elevator operation between each floor is 2 seconds, and when the time for each stop of the elevator car is 10 seconds, f1(t), an estimate arrival time of the first car, and f2(t), an estimate arrival time of the second car, are respectively obtained by the following equations.

$$f1(t)=14*2+10*W*(0.4+0.2+0.1+0.1+0.2+0.2+0.5+0.4+0.8+0.6+0.7+0.3+0.5)=28+5*5=53 \text{ seconds}$$

$$f2(t)=8*2+10*W*(0.5+0.4+0.6+0.7+0.3+0.5)=16+5*3.8=35 \text{ seconds}$$

The estimate arrival time of the first car to a 16th floor, which is obtained from the above equation is 53 seconds, and the estimate arrival time of the second car to the 16th floor is 35 seconds. Accordingly, a hall call which is not allocated yet is allocated to the second car having the faster estimate arrival time. Of course, in a synthetic evaluation function, the allocation is not carried out only by the estimate arrival time. However, since a method for applying the hall call to the allocation is as same as the above-described method, and an estimate hall call generation probability is predetermined at a certain value and uniformly applied to such an allocation method, several problems are occurred as follows.

A distance between a hall call generated floor and a car takes the greatest part in the allocation. Therefore, in determining a car for servicing, even though the estimate hall call generation probability at each floor is changed, the change may not affect on allocating the second car.

Also, when a first section is from an 8th floor to the 16th floor, and when a second section is from a 2nd floor to a 7th floor, applying the estimate hall call generation probability of the upward direction in the first section to both of the first and second cars means that both of the first and second cars are allocated with respect to all future hall calls, which is logically inconsistent. That is, the estimate hall call generation probability applied to the first car should not be applied to the second car.

In addition, when the second car is allocated to hall calls generated in the first section and the hall call generated at the 16th floor, a time for servicing the hall call at the 16th floor is increased, while a serviceability with respect to the hall call in the first section is improved.

On the other hand, when considering the service for the future hall call, it is more proper for a third car to service the hall calls generated in the second section and for the first car to service the hall call on the 16th floor although the estimate arrival time of the first car is slower than that of the second car, since the estimate hall call generation probability in the second section is smaller than that in the first section. In order to consider the above aspect, a probability of a future generated hall call, that is an estimate hall call generation probability, should be considered, however it is difficult to consider the above-described matters in the conventional apparatus.

Also, after an allocation to the previously generated hall call is determined, an allocation to future hall call should be considered as well. For example, after it is determined that the second car is allocated to all of the estimate hall calls in the first section, and the third car is allocated to the hall call in the second section, it should also be considered which car will be allocated to a newly generated hall call.

In addition, a method for allocating a car by an evaluation function ($\phi$) is applied as an algorithm which searches an optimum solution by considering various current and future states of each elevator. Here, the current states of the elevator are a current location of the elevator, an operation direction of the elevator, an operation speed of the elevator, and a number of passengers, and hall call and car call which are previously allocated, etc., and the future states of the elevator are an estimate number of passengers, an estimate arrival time of a car for servicing a hall call, a probability for which the car stops on other floors while servicing to a floor at which a hall call is generated, and a location of the elevator at a predetermined time, etc..

$$\phi_k=\alpha_1 \cdot X_{1k}+\alpha_2 \cdot X_{2k} \quad (1)$$

wherein $\phi_k$ is an evaluation function of a Kth car, $\alpha_i$ is a weight value, and $X_{1k}$ is an evaluation value of an estimate arrival time with respect to each hall call when considering location and stop probability of the Kth car, and $X_{2k}$ is an evaluation value obtained by considering congestion of a Kth car and long-term waiting probability of a Kth car.

When a hall call is newly registered, an allocation of the new hall call is evaluated on the basis of the evaluation function ($\phi$), and a car having the smallest evaluation value is allocated as a result of the evaluation. However, such a method may not appropriately consider the estimate hall call, thereby being not capable of responsibly adapting to the change of the transport kind.

Accordingly, in order to allocate an optimum car by synthetically considering various future states using the conventional apparatus, the estimate hall call should be evaluated by additionally considering an estimate hall call generation probability which varies dependent upon the above-described situations.

However, to consider the estimate hall call generation probability, an estimate hall call with respect to each floor, an estimate hall call to an operational direction of each car, etc. should additionally be considered, whereby a solution may not be obtained within a predetermined time since computation volume of the conventional apparatus is rapidly increased, and a serviceability of the elevator may not be dropped due to inefficient computation.

SUMMARY OF THE INVENTION

Accordingly, it is an object of the present invention to provide a group management control method for an elevator which generates an estimate transport kind by using an estimating means, computes a future hall call generation probability by each floor and direction on the basis of the estimate transport kind, and applies a genetic algorithm to an allocation based from a value of the future hall call generation probability, thus capable of servicing an optimum car to a passenger.

To achieve the above objects, there is provided a group management control method for an elevator which includes:

a first step for dividing a domain of a building into predetermined sections to be suitable for various states of transport demand, and computing a number of future hall calls which will be generated in each section; a second step for obtaining a future hall call generation probability on the basis of an estimate number of passengers in accordance with a result obtained in the first step, and setting up future hall call generation floor and direction based from said probability according to predetermined rules; a third step for adopting the result obtained from the first step as base data, obtaining an evaluation value of each car by using a synthetic evaluation function, and selecting at least two cars which have an evaluation value of a high priority according to the predetermined rules; and a fourth step for receiving a result obtained from the second step and the allocated cars selected in the third step, and selecting one car which is regarded as an optimum car to be allocated by applying the genetic algorithm thereto.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a diagram illustrating an operational situation of an elevator in order to describe an operation of the conventional apparatus;

FIG. 6 is a table illustrating an example of an evaluation function according is to the present invention;

FIG. 7 is a table illustrating an example of a probability of selecting a parent car according to the present invention;

FIG. 10 is a diagram illustrating an operational situation of an elevator applied to the method according to the present invention;

FIG. 11 is a table in which a solution according to the present invention is encoded to a genetic type;

FIG. 13 is a table illustrating expectations of an estimate arrival time;

FIG. 15 is a table illustrating an operational situation of a temporarily allocated floor;

FIG. 16 is a table illustrating an example of an allocation suitability according to the present invention;

FIG. 17 illustrates a car allocated to a hall call which is newly generated;

FIG. 18 illustrates an incomplete genetic sample according to the situation illustrated in FIG. 10;

FIG. 19 is a table illustrating a car which may not be allocated according to an arrival time;

FIG. 20 illustrates a complete genetic sample; and

FIG. 21 is a diagram illustrating an evaluation value of the genetic sample in FIG. 20.

DETAILED DESCRIPTION OF THE INVENTION

The operation and effect of a group management control method of an elevator according to the present invention will now be described with reference to FIGS. 4 to 25.

A genetic algorithm applied to the method according to the present invention is suitable for a system with a vast search space, and a rough explanation thereof is as follows.

The genetic algorithm is a theory introducing evolutionism to solve the problems occurred in the conventional art, and is applied as a method for solving the problems when it is difficult to obtain an accurate solution due to complexity of the problems. According to the evolutionism, a dominant gene is generated through process such as parent gene synthesis, mutation generation, natural selection of a recessive gene, etc..

A parent gene is selected among several samples (initial values) for which an actual solution for the problems are expressed in a genetic type in accordance with a predetermined method, and a new offspring gene is produced by synthesizing selected parent genes or generating a mutation, and a new generation is continuously generated by synthesizing the offspring and initial gene (population or sample), thus selecting a gene having a biggest evaluation value after a predetermined generation is passed, and considering information of the gene as an optimum solution to the corresponding problems.

In order to obtain a solution using the genetic algorithm, two prior operations should be performed as follows.

First, the solution should be expressed in a genetic type which is shown below. That is, the solution may be formed in a bit type as shown in Example 1, or a natural number type as shown in Example 2, or a real number type.

Example 1: gene 1(0 0 0 1 1 1 1 0 1 0 1 0 0 0 0 1 0 1)

Example 2: gene 2 (1 2 3 4 6 21 16 79 66 33 52 14 6 32 0)

Second, an evaluation function which may evaluate each gene should be developed. In fact, information required in the gene algorithm is only the evaluation function which evaluates whether or not the solution is accurate. That is, one of the advantages of the genetic algorithm is that there is no need to have a mathematical modeling for a system.

A gene which has an excellent evaluation value obtained by the evaluation function may multiply more than a gene which has a poor evaluation value. That is, the evaluation function serves as the natural selection in a natural phenomenon.

To apply the thusly obtained solution to a reality, decoding the solution which is expressed in the genetic type to information in the present state.

Figure 5:
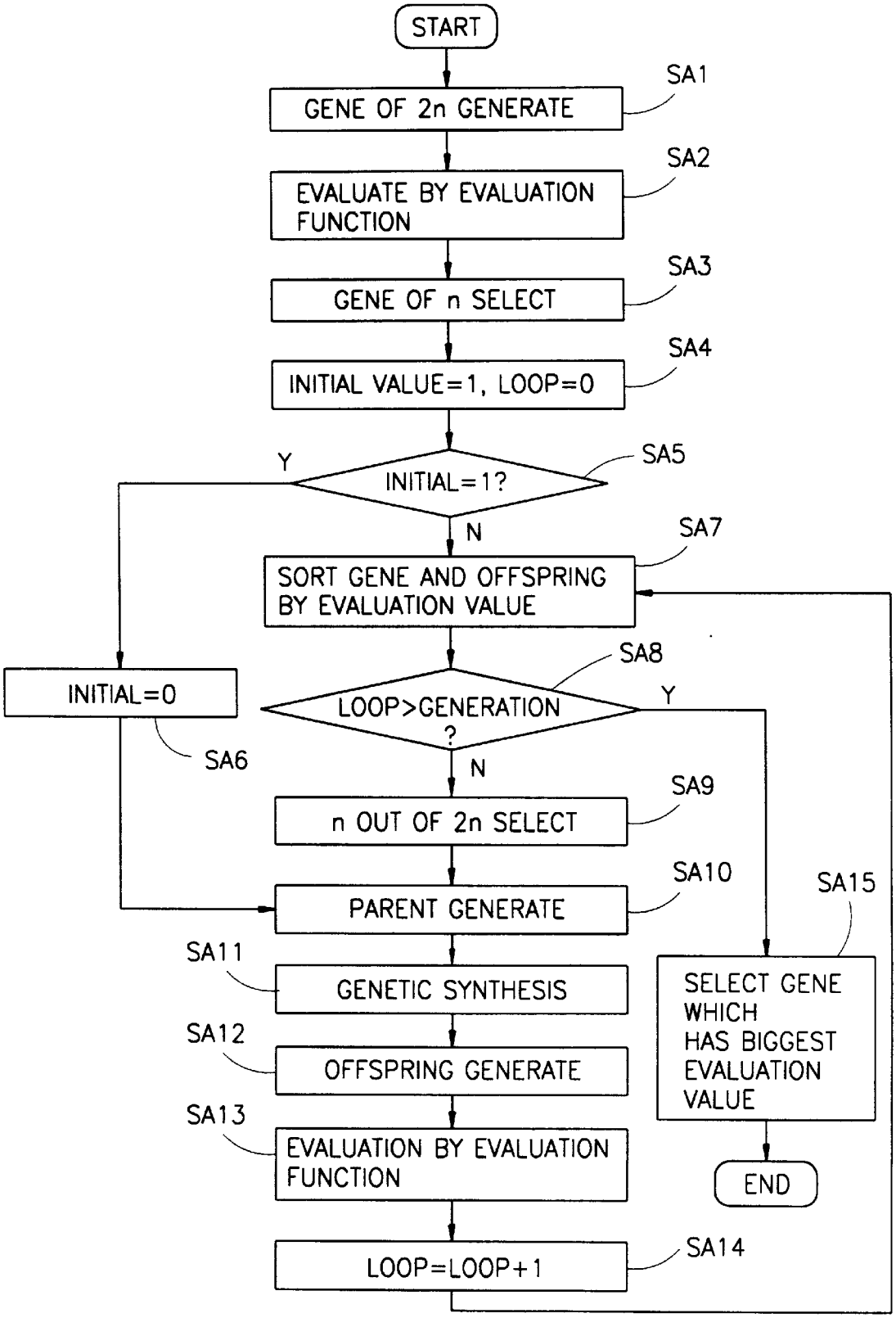
FIG. 5 is a signal flow chart of a genetic algorithm which is applied to the method according to the present invention.

FIG. 5 is a flow chart illustrating the genetic algorithm. First, a temporary solution is generated among possible solutions as samples of 2n units (SA1). The 2n samples are respectively evaluated by the evaluation function, and a parent of n unit is generated (SA2,SA3). Here, the parent is generated in proportion to each evaluation value of the solution. Namely, by increasing a probability for which a solution having an excellent solution becomes the parent, and decreasing a probability for which a solution having a poor solution becomes the parent, the parent gene comes to have a higher probability to have the excellent evaluation value than the sample gene on average.

There are various methods for generating the parent, however the method shown as follows is generally applied.

Suppose that the evaluation value in accordance with each of five solutions is obtained as shown in FIG. 6, when solutions (No.1–No.5) for a problem are expressed in the bit type, and the solutions are respectively evaluated by the evaluation function.

In this case, a probability for which each individual is selected as the parent is as shown in FIG. 7. On the basis of the probability, five parents are selected. According to selected parent gene of n unit, a new solution (an offspring) is generated by a genetic synthesis as shown in FIG. 8, or the mutation generation as shown in FIG. 9 (SA11, SA12).

The genetic synthesis is occurred by substituting other part for a part of a genetic arrangement at a fixed probability, that is the mutation generation, or by crossing over each elements of two respective genes.

Figure 8:
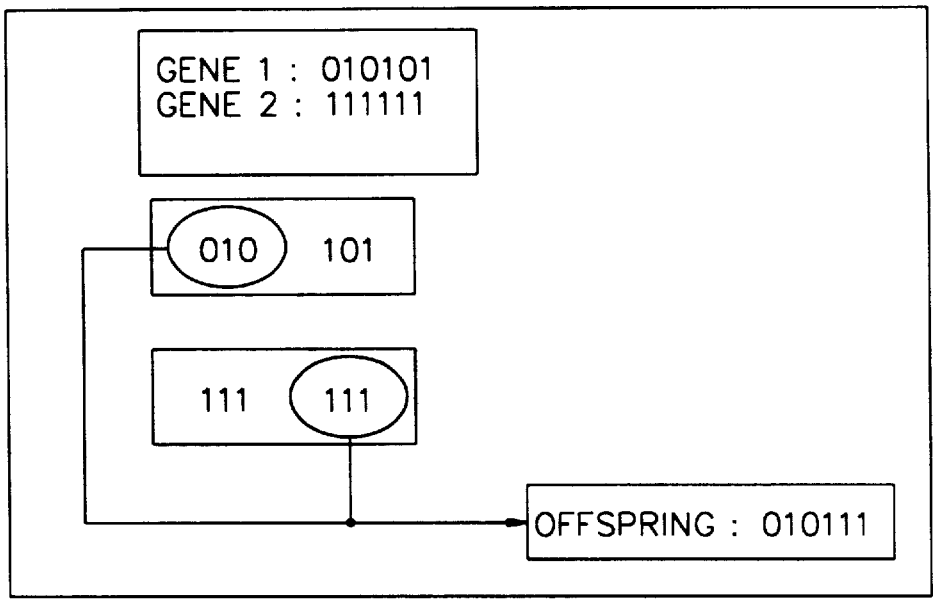
FIG. 8 is a diagram illustrating a genetic synthesis process.

For example, as shown in FIG. 8, an offspring 1 '010111' is generated by crossing over each gene of a solution 1 '010010' and of a solution 2 '111111' as shown in FIG. 6.

Figure 9:
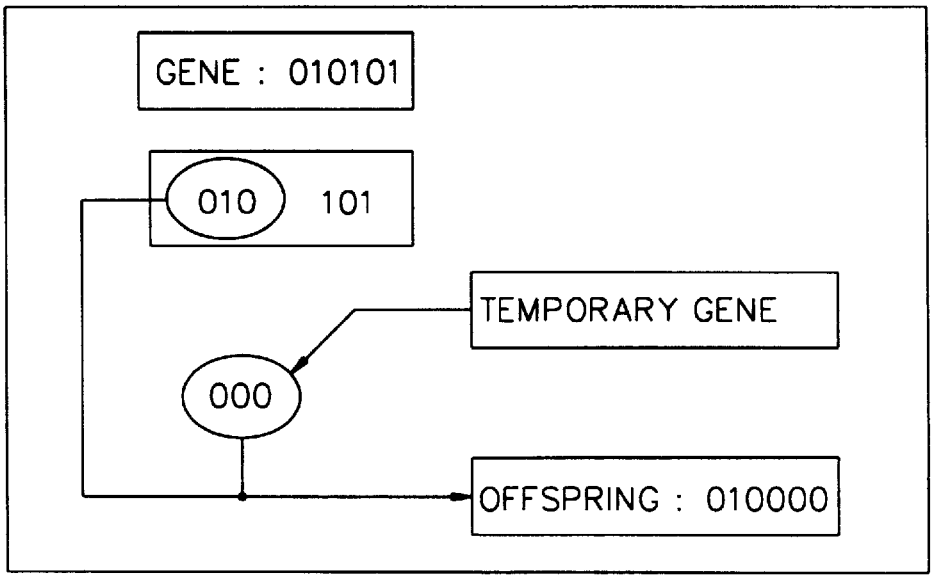
FIG. 9 is a diagram illustrating a mutation generating process.

As shown in FIG. 9, mutation generating process generates temporary elements '000' of a gene which does not have their parents, and produces a new gene, that is the offspring, '010111'.

The thusly generated offspring is evaluated by the evaluation function (SA13), and the evaluation value of n unit is selected in the order of an evaluation value by putting in order of an evaluation value of the offspring and an evaluation value of a solution population, the initial sample, and an offspring is generated by selecting a parent of n unit from the elected element of n unit.

The above process is repeated for a predetermined number, for thus obtaining a gene, which has the best evaluation value among genes which remain to the end, as the solution.

In order to apply the genetic algorithm to an allocation algorithm, the conditions shown as follows should be satisfied.

First, a solution according to an allocating operation should be encoded to the genetic type.

Second, an evaluation function for evaluating the solution should be needed.

Third, since an accurate solution can be obtained within a short time when an initial sampling is appropriate, an algorithm capable of properly selecting an initial solution population.

Fourth, on the basis of solutions evaluated by the evaluation function, there should be provided a method for selecting a parent which is necessary to generate an offspring. Fifth, there is needed an algorithm which properly synthesizes parent genes to correspond to the allocation algorithm and generates a mutation.

A method for satisfying those five conditions will be described as follows with reference to a situation as shown in FIG. 10.

As shown in FIG. 13, suppose that a number of floors is 12, and four elevators are provided in a building.

A shown in FIG. 10, an estimate hall call generation probability by each floor and direction is previously determined, and a 9th floor upward hall call and a 5th floor downward hall call are previously allocated in a 2nd car and a 4th car, respectively. A 1st car is ascending to an 11th floor where a car call (a passenger presses a button of a desired floor inside the car) is generated, and a 3th car is in a stop motion after completing all services. In the above situation, a 1st floor upward hall call is generated.

Encoding a solution to a genetic type

FIG. 11 is a table in which a solution according to the allocating operation is encoded to the genetic type. Here, there are three individuals, a, b, and c, and a number written on a same line as each individual indicates a car number.

A rectangular thick solid line indicates a previously allocated floor and a car number allocated to the floor. Here, a 9th floor upward hall call is assigned to the 2nd car, thus a number '2' is shown, and a 5th floor downward hall call is assigned to the 4th car, thus a number '4' is marked. In addition, allocations to a 12th floor upward hall call and to a 1st downward hall call do not exist, whereby a number '0' is marked.

As shown in FIG. 11, when interpreting genetic information of an individual 'a' indicated as "1431234222400233-42313443", the 1st car is allocated to a 1st floor upward hall call which is not allocated, and the 4th car is allocated to a 2nd floor upward estimate hall call, and the 1st car is allocated to a 3rd floor upward estimate hall call.

When an individual 'b' is selected as a final solution according to the present invention, the 4th car will be allocated to a 1st floor upward hall call. That is, the 4th car is an actual solution, and a future hall call is allocated to remaining floors and direction, namely a car corresponding to an indicating number will be allocated to an expected hall call.

On the other hand, according to the conventional synthetic evaluation function, when there are four cars as the above example, a maximum number of cases is four, that is allocating the 1st upward hall call to the first, second, third, or fourth car.

However, since the genetic algorithm searches an optimum crossover method among various possible crossover methods, serviceability of a hall call which will be generated in near future is also considered, and a car which is determined to have the best among possible solutions is allocated.

An evaluation function for evaluating a gene of each solution and a method for evaluating the same To appropriately include the estimate hall call generation probability in the evaluation function, the three subjects described as follows are considered on the basis of the synthetic evaluation function.

First, when applying an estimate hall call generation probability to each car, a respectively different probability is applied to each different car. The estimate hall call generation probability is a probability which a hall call is generated within 1 minute in general. Since each time for which the first and second cars service to a 6th floor as shown in FIG. 10 is different, it is not proper to allow an identical evaluation value to the first and second cars in accordance with 0.4 of the estimate hall call generation probability of a 6th floor upward direction as shown in FIG. 10. That is, since the 2nd car passes through the 6th floor within a short time, the probability, which the 1st car will service the estimate hall call of the 6th floor upward direction, is higher than the probability which the 2nd car will service.

Figure 12:
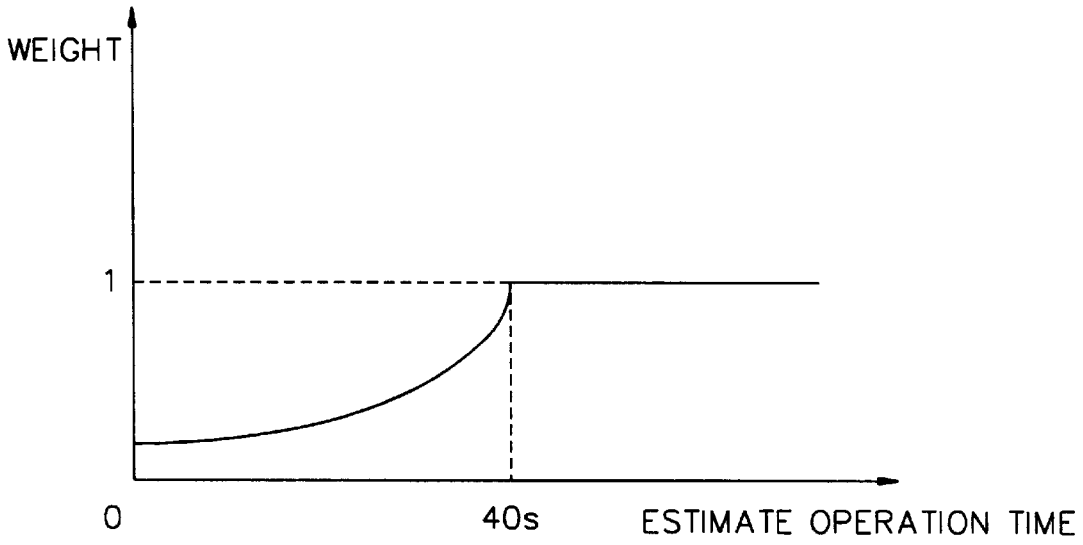
FIG. 12 is a graph illustrating a weight of an estimate hall call according to a time interval between each floor.

Accordingly, a weight according to an estimate arrival time (t) is separately computed by each car with respect to the estimate hall call. FIG. 12 illustrates a function of the estimate arrival time and the estimate hall call generation probability. Here, the weight is a value of each car, floor, and direction, the value ranges from 0 to 1. Here, the value '0' means that the estimate hall call generation probability will not be considered, and the value '1' means that a value of the estimate hall call will be included in the evaluation function as it is.

Second, it is a method for computing the estimate arrival time which becomes the basis of all evaluations. Since the hall call generation probability means a generation probability to the letters, when the estimate arrival time is computed on the basis of a generation probability, the estimate hall call may be generated or not in reality. Therefore, the estimate arrival time should be computed by considering various situations.

According to the present invention, a concept of an estimate waiting time is introduced to the estimate arrival time, and thus the estimate hall call generation probability is applied to the allocating method.

Obtaining expectation of the estimate waiting time will be described with reference the accompanying drawings. Here, for the convenience of computation, the weight of the hall call generation probability is fixed as 1.

According to a solution 'b' as shown in FIG. 11, floors for which the 4th car should service are 2nd, 3rd, 5th, and 7th floors (when the downward direction is considered) each of which is circled, and a downward stop probability of each floor is 0.4, 0.3, 1.0, and 0.6, respectively.

FIG. 13 illustrates the expectation of the estimate arrival time by considering all the situations which may be generated in reality. As shown therein, T (true) indicates a case where the estimate hall call is actually generated, and F (false) is a case where the estimate hall call is not generated in reality. A 'F' generation probability is "1—a hall call generation probability" with respect to corresponding floor and direction.

A generation probability of each case is a probability for which a hall call of each floor may be generated or not, as shown in FIG. 13. Since a 5th floor downward hall call is a hall call which is previously allocated to the 4th car, only T is existent in the expectation computation, that is the call of each floor is always generated.

Now, the estimate arrival time to each case will be described.

When the hall call of each floor is generated, a car stopping number is four. Therefore, a delay time according to each stop is 40 seconds, a time required for operating between each floor is 2 seconds, and a number of floors is 7, thus the total time required is 14 seconds. Accordingly, the expectation of a case 1 is 0.072 * (14+40)=3.888. Thus, 38 seconds is the expectation (an expectation of the estimate arrival time), and a value of the expectation becomes the expectation of the estimate arrival time, when the 4th car is allocated to all downward hall call which are generated at the 2nd, 3rd, 4th, and 7th floors. On the basis of the thusly obtained estimate arrival time, other evaluation is estimated on control objects of a general group management, such as decreasing a long-term waiting probability, an average waiting time, and a service error.

Third, it is an evaluation value computation method. The operation for the method will be described with reference to FIG. 14.

As shown therein, a gene is interpreted, thereby determining which car is allocated to which floor and direction in a first step (SB1). The process will be described according to an example of the genetic individual 'b' as shown in FIG. 11.

In accordance with the individual gene 'b', floors to which the 1st car is temporarily allocated are 2nd and 5th floors in the upward direction, and 6th, 8th, and 12th floors in the downward direction. FIG. 15 is a table illustrating an operational situation of each temporarily allocated car to each floor. Here, 'o' is indicated at a floor which will be allocated to each car.

In order to obtain the estimate arrival time according to each estimate hall call and previously allocated hall call, a service priority of each car with respect to an allocated floor should be determined (SB4). For example, the allocation priority of the 1st car is an upward 2nd floor→an upward 5th floor→a downward 12th floor→a downward 6th floor.

In a step 7 (SB7), the expectation of the estimate arrival time of each floor, is obtained. Here, the expectation of the estimate arrival time is obtained at each floor as described above. For example, in order to obtain the expectation of the estimate arrival time of the 1st car which is upward to a 5th floor in an operational situation as shown in FIG. 10, all of possibilities which may occur should be obtained. Here, the possibilities are two cases, that is whether or not a 2nd upward hall call is generated. Because, the floors, temporarily allocated to the 1st car in the upward direction, are 2nd and 5th floors.

On the basis of the evaluation function, an evaluation is performed to the thusly obtained estimate arrival time. The evaluation function has a same logic frame as the synthetic evaluation function in the equation (1). A value evaluated by the evaluation function is not accumulated, but is multiplied by a generation probability of each hall call and, thereby being accumulated, thereby becoming the evaluation value which is proportioned to the hall call generation probability.

An accumulated evaluation value=an evaluation value+a hall call generation probability * ( a value of an evaluation function by each car, direction, and floor) . . . (2)

Here, the evaluation is performed to all hall calls and cars, and a value of the accumulated evaluation value is considered as an evaluation value of a corresponding gene.

Selecting a solution as an initial sample population

In order to apply the genetic algorithm to the allocation algorithm, the third situation which should be satisfied is to determine which solution will be selected as the initial sample population among various solutions. Since a method for selecting the sample is affected to a time from which a value of the evaluation function becomes accurate, that is a convergence time, the initial sample should be selected carefully.

According to the present invention, the above matter is solved by using the evaluation value of the conventional synthetic evaluation function. Generally, each car is evaluated by synthesizing a state of each car, floor and direction of a new hall call, and a future hall call, etc., and a car having a smallest evaluation value is allocated to a corresponding hall call.

In fact, even though the evaluation function of the group management is determined at any type, values of cars which comparatively have an evaluation value in a high priority are about the same. However, determining which car, among the cars which comparatively have an evaluation value in a high priority, will be allocated controls efficiency of each algorithm.

Accordingly, the above-described fact should be considered in the method for obtaining the initial sample according to the present invention.

That is, an evaluation value of each car is computed by using the conventional synthetic evaluation function, and by applying the evaluation value the genetic algorithm obtains a probability which will be selected in a same method as FIG. 7. A car of n unit, which will be allocated to floor and direction corresponding to a hall call which is not allocated, is selected by using the obtained probability.

The method for obtaining the initial sample will be described as an example of an operational situation of an elevator as shown in FIG. 10.

A 1st upward call hall is a fact which should be firstly solved. A problem is which car is allocated to the 1st upward call hall. First, according to the conventional allocation method, each car is evaluated by the synthetic evaluation function in a way of judging an allocation suitability with respect to the 1st upward hall call. Since an evaluation value has a small value as a car becomes suitable for the allocation, the evaluation value should be encoded to the allocation suitability, and a value of the suitability is as shown in FIG. 16. Here, the value of the suitability is in inverse proportion to the evaluation value.

Figure 1:
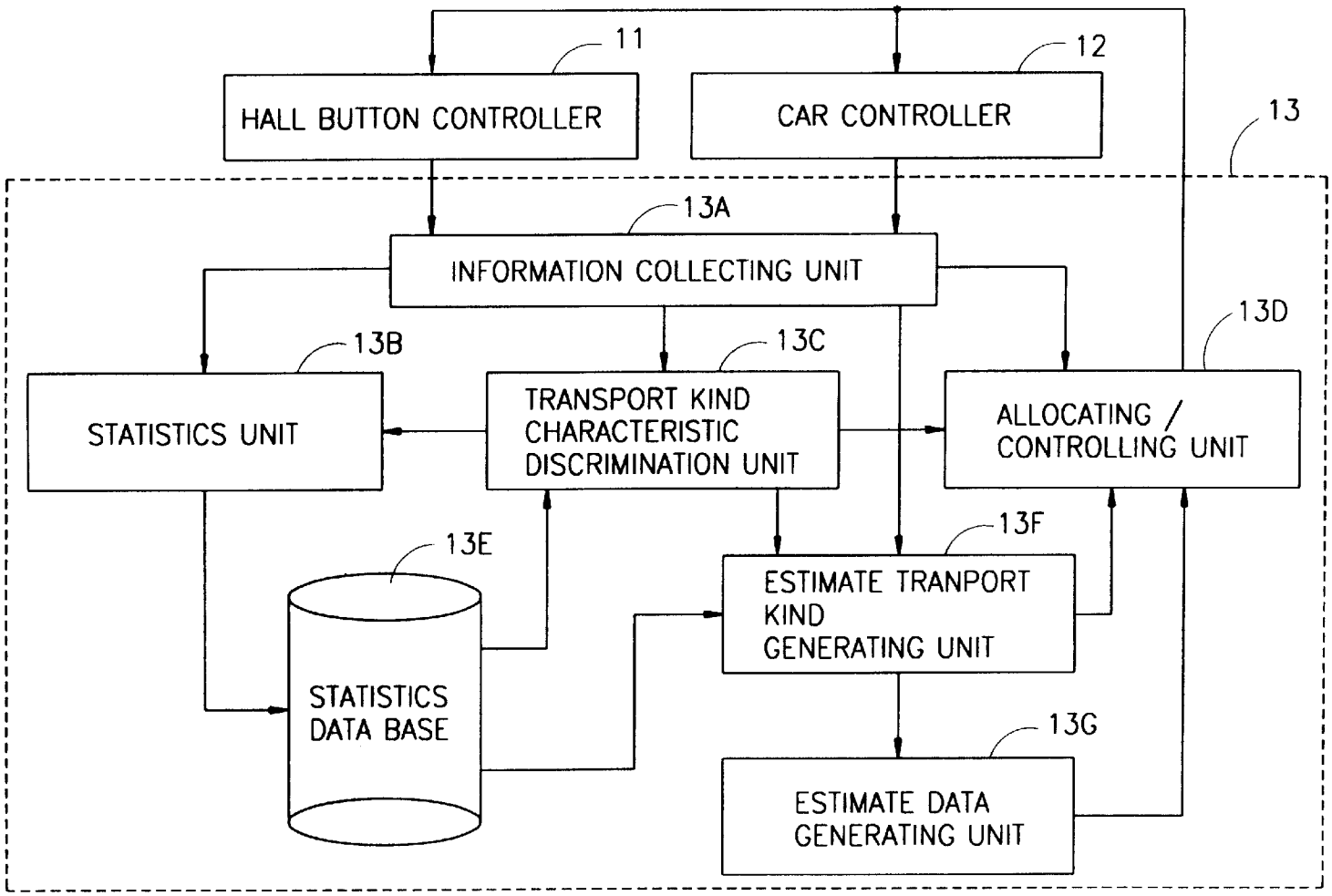
FIG. 1 CONVENTIONAL ART
FIG. 1 is a block diagram illustrating an allocating apparatus for a conventional group management system of an elevator.
Figure 3:
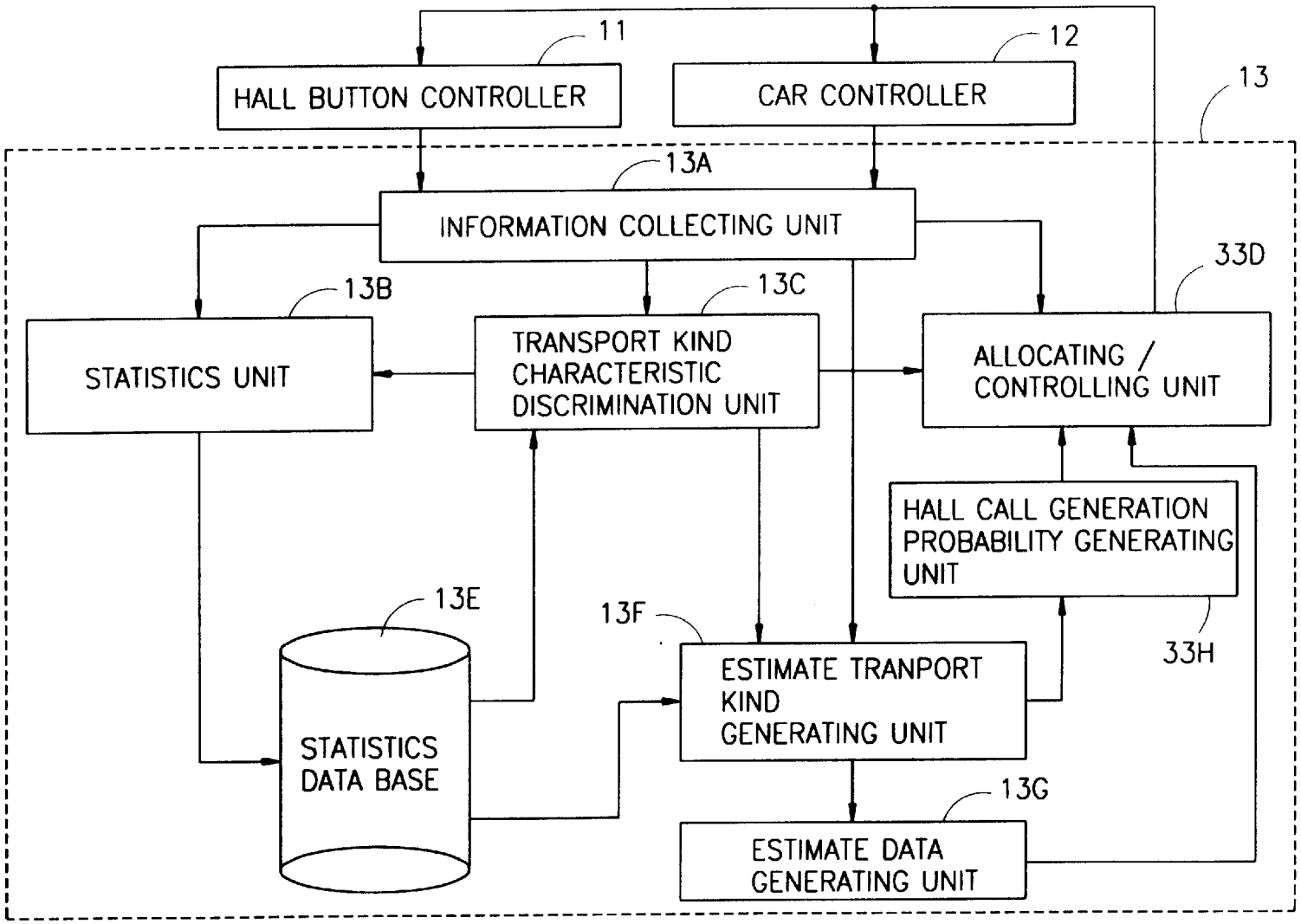
FIG. 3 is a block diagram illustrating an allocating apparatus for a group management system to which a group management control method for an elevator is applied according to the present invention.
Figure 4:
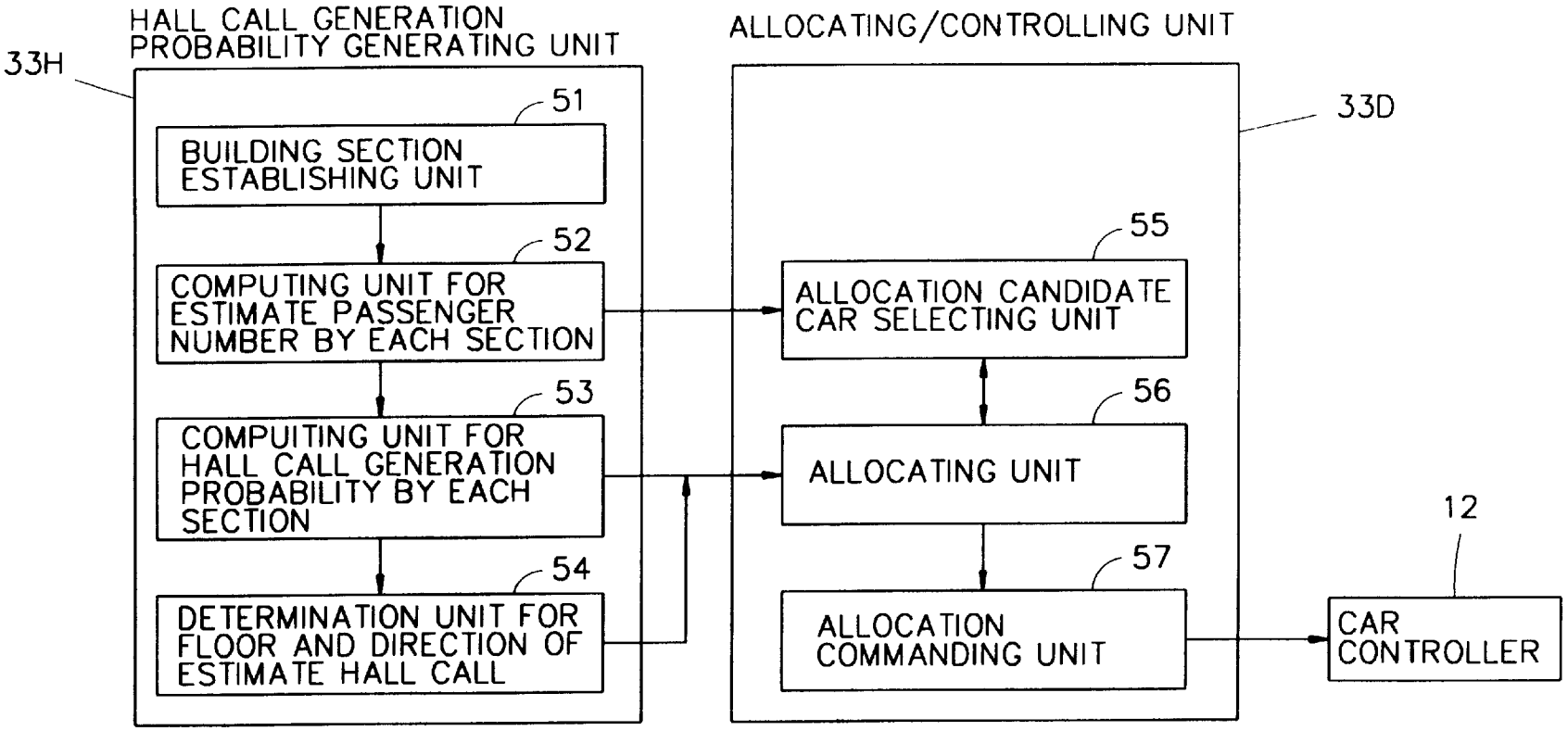
FIG. 4 is a detail block diagram illustrating a hall call generation probability generating unit, and an allocating/controlling unit in FIG. 3.

When three allocation candidate cars are selected out of four cars, the 1st car is excluded, and the operation is carried out in an allocation candidate car selecting unit 55 as shown in FIG. 4. A probability corresponding to a value of each of the three allocation candidate cars is obtained, and a sample is generated by each probability. When a new hall call is an 1st floor upward hall call, a car allocated to the new hall call is selected 10 times according to the probability, as shown in FIG. 17.

Here, it should not be overlooked that the 1st car is not allocated to the 1st floor upward hall call. Since a number of a car which is at the 1st floor in the upward direction is an actual number of a car which will be allocated, obtaining the car number according to the synthetic evaluation function by using the probability forms the foundation of which the genetic algorithm quickly obtains an accurate solution.

Since other car may not be allocated to each hall which is previously allocated, a car number which is already allocated to each hall call is recorded in a space of floor and direction of the previously generated hall call. In addition, suppose that a car having a car call is allocated to an estimate hall call in an identical direction generated at each car call generated floor.

According to the situation as shown in FIG. 10, since the 1st car has an 11th floor car call and is in the upward direction up to the corresponding floor, suppose that the 1st car is allocated to an 11th floor upward estimate hall call. In addition, since the 2nd car is previously allocated to a 9th floor upward hall call, and thus '2' corresponding to the 2nd car is recorded in a 9th floor upward box, suppose that the 3rd car is allocated to a 12th floor downward estimate hall call. Also, since the 4th car is previously allocated to a 5th floor downward hall call, '4' corresponding the 4th car should be recorded in a 5th floor downward box. According to the situation shown in FIG. 10, an incomplete genetic sample is shown in FIG. 18.

Now, the incomplete 10 genes may properly be completed, and one of methods therefor is to generate a random number within a car number (1st–4th cars) and to record a proper number, or intention of a deviser is included to the method.

In the method according to the present invention, is suggested to include the intention of the deviser in order to obtain a quick and accurate solution.

As a first suggestion, even though a car operates at a maximum speed which is physically possible, a corresponding car is not temporarily allocated, that is a corresponding car number should not be recorded a blank, in a section where a service is impossible within 50 seconds, or in a section (a floor and a direction) having a high service impossibility. Therefore, when the genetic algorithm is performed, an accurate solution can be quickly obtained.

As an example of the situation as shown in FIG. 10, supposing that an operational time of each car between each floor is 2 seconds, and 10 seconds are required at each stopping floor, when an arrival time of each car (A shortest arrival time on the basis of the current situation) is computed, a box in which a time is more than 50 seconds is circled as shown in FIG. 19. Here, when generating the random numbers, an estimate hall call corresponding to a circled floor and direction should be considered so that a corresponding car is not temporarily allocated.

As a second suggestion, a car allocated to a hall call of a certain floor is also allocated to a hall call of a floor which is adjacent to the said floor. That is, as shown in FIG. 18, when the 2nd car is allocated to a 9th floor upward hall call, the 2nd car is also allocated to an 8th floor hall call and to a 9th floor hall call.

Generally, when a car, which is previously determined to service an objective floor, is allocated to a hall call of a floor adjacent to the objective floor, one car takes charge of the hall calls of neighboring floors, thus energy consumption is reduced, and the cars are evenly distributed for servicing. Accordingly, a corresponding car number is registered in an estimate hall call which is adjacent to a previous allocated hall call.

However, when a corresponding car number is excessively registered to hall calls of neighboring floors, a single car is too much loaded, thus main performance of the group management system, such as the long-term waiting probability, is deteriorated. Therefore, appropriate range selection of floors according to a transport situation is required.

In addition, temporary allocation is performed in a type of which a car continuously services neighboring floors (when random numbers are generated, there is a high probability that a number has identical numbers in neighborhood).

FIG. 20 illustrates the incomplete genetic sample in FIG. 18 that has been completed. As shown therein, a car having a circled number as shown in FIG. 19 is not temporarily allocated to an estimate hall call of corresponding floor and direction, and a car number of a floor adjacent to a previously allocated floor is registered with a number as same as a car number of the previously allocated floor. (Since the 3rd car in the stop motion, having no hall call or car call for servicing, is able to service to any floor and direction within 50 seconds, the computation thereof is excluded.)

Accordingly, samples are produced by reflecting the intention of the deviser, thus obtaining samples having dominant genes as many as possible.

Selecting a parent gene among produced samples

Figure 14:
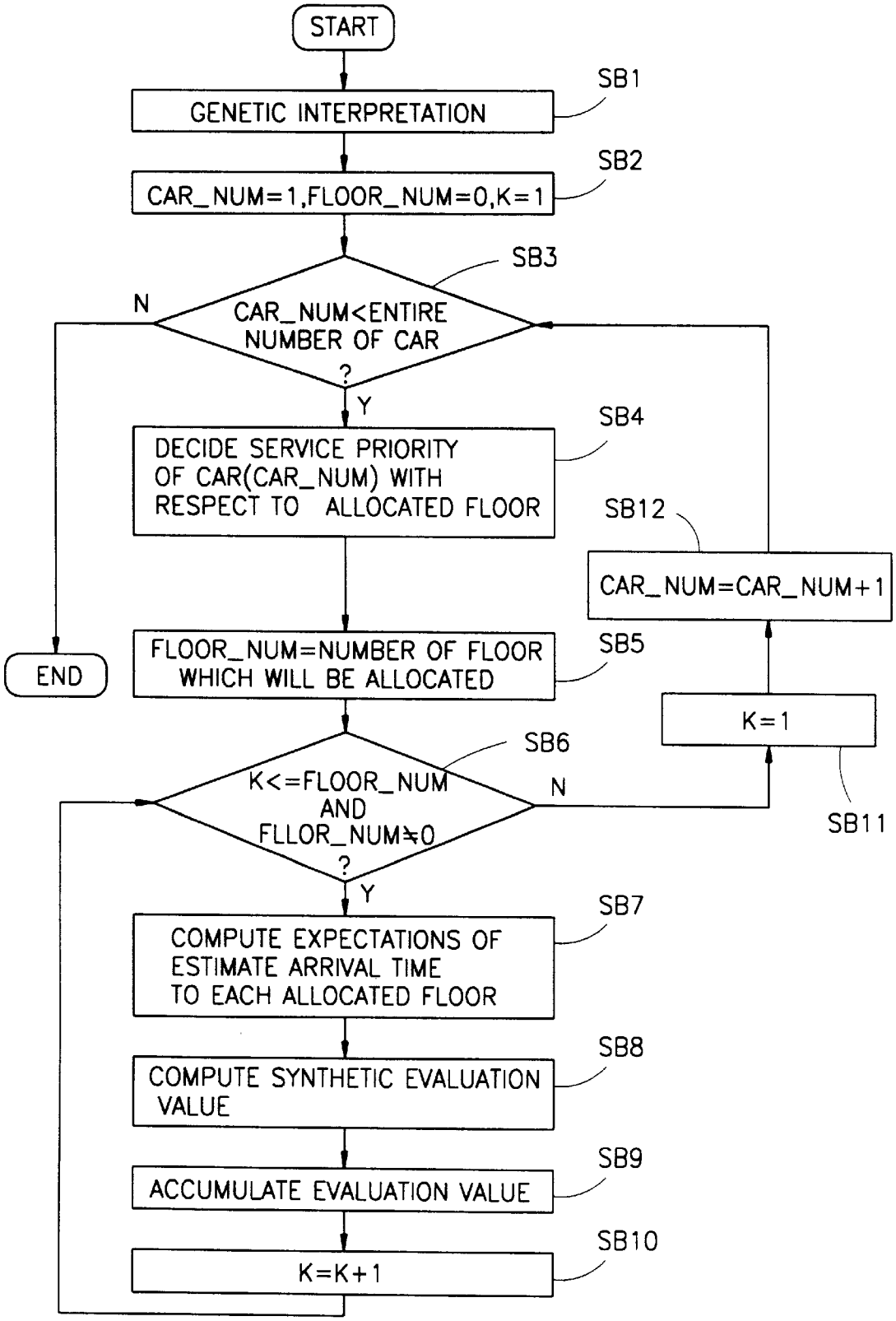
FIG. 14 is a flow chart illustrating computation of an evaluation value of the genetic algorithm applied to the method according to the present invention.

For a method of selecting a parent gene among the produced samples, according to the method of the present invention, the samples are evaluated by the evaluation function according to the method as shown in FIG. 14, for thereby generating a parent gene. If evaluation values of gene samples (a-j) are as shown in FIG. 21, the parent gene is selected by a probability which is in inverse proportioned to the evaluation values. In an example of FIG. 21, a probability that 'a' will be selected as a parent gene is three times as much as that of 'b'.

A method of selecting a parent gene among samples and a method of selecting samples are about the same. However, when selecting samples, each value of the samples is proportioned to a value of the synthetic evaluation function. Also, the parent gene is selected on the basis of an evaluation value computed by including an estimate hall call, a previously allocated hall call, and a hall call which is not allocated, which are generated by each floor and direction as described above.

Generating an offspring

A method of generating an offspring of a next generation by synthesizing parent genes and producing a mutation adopts a general method performed by the genetic algorithm, however there are several facts which must be observed.

Floor and direction which are previously allocated should not insert other car number, except a corresponding car number. In other words, an initial value of the previously allocated floor and direction is continuously maintained. In addition, a number of a car, which is adjacent to a car which is previously allocated and is allocated to a hall call having a same direction as an operational direction of the previously allocated car, should not be changed, thus reflecting the intention of the deviser.

A value of a hall call, which is not allocated and generated according to an evaluation value of the evaluation function in the early stage, should not be changed. For example, when changing a value of a car number allocated to the 1st floor upward hall call as shown in FIG. 20, a convergence time of an evaluation value of a solution becomes very slow, thus system stability is dropped off. Maintaining a value means discrimination of the evaluation function with respect to an allocation is considered. Accordingly, an erroneous operation of the genetic algorithm is prevented.

Lastly, in genetic synthesis and mutation generation, a car number is not recorded to floor and direction which correspond to an allocation prohibition area computed by each car.

After generations are produced as many as a predetermined number according to the above description, a gene having an optimum evaluation value is selected by evaluating a last generation and a sample which becomes a basis of producing the last generation. Thus, a car, corresponding to a floor and a direction of a hall call which is not allocated, is allocated to the hall call. The allocated car is determined as an optimum car which is the most suitable for the hall call which is not allocated, when considering current and future situations.

Additionally, as described above, a lot of computing operations are required in applying the genetic algorithm to the allocation. Also, when there are many floors and cars to be computed, computation congestion may occur. Therefore, according to the present invention, it is suggested to have a method in which a building is divided by each section and each direction, and an estimate hall call which becomes a representation of each section is applied to the allocation, and the operation thereof is described as follows.

Step 1: A building is divided in to several sections by a location and a direction, and a probability that a hall call is generated in each section, that is the hall call generation probability, is computed. The computing operation applies mean values of the hall call generation probability, which are generated by each floor and direction.

Step 2: To apply the hall call generation probability computed by each section to the allocation, assumption which will be as follows is provided. That is, suppose that hall calls which are generated in a certain section are only generated in predetermined floors of the corresponding section. For example, a floor which has the largest number of estimate passengers among floors of the section is determined as a representative floor of the corresponding section, and the representative floor only generates a hall call, thus reducing an entire number of genes and reducing computation volume consumed for the allocation.

As described above, the method according the present invention obtains the hall call generation probability, processes the hall call generation probability, and applies a resultant to the genetic algorithm which is known to be highly efficient in a system with a large search space, thereby capable of decreasing an average waiting time and a waiting generation probability, and providing a high-quality service to passengers.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. A group management control method for an elevator, comprising:

receiving a passenger hall call;

dividing a domain of a building into predetermined sections suitable for various states of transport demand;

computing a number of hall calls which will be generated in each section;

obtaining a future hall call generation probability on the basis of an estimate number of passengers in accordance with a result of said step of computing;

determining floor and direction for wich a hall call is generated based on the generation probability according to a first predetermined rule;

adopting a result obtained from said step of computing as base data;

obtaining an evaluation value of each car for responding to the passenger hall call by using a synthetic evaluation function;

selecting more than two cars which have high evaluation values according to a second predetermined rule; and applying a genetic algorithm to allocation candidate cars selected in said step of selecting and to a result obtained in said step of obtaining, to thereby select one car which is regarded as an optimum car to be allocated for the passenger hall call.

2. The group management control method of claim 1, wherein said step of applying comprises encoding an allocation type to a genetic type by which a previously allocated hall call has taken charge of a car which is allocated to the passenger hall call, one car among cars which are controlled in a group management is temporarily allocated to a hall call and an estimate hall call which are generated by a floor and a direction according to the first predetermined rule.

3. The group management control method of claim 1, wherein said step of applying comprises generating an initial genetic sample by selecting the allocation candidate cars by using the synthetic evaluation function and assigning a temporary allocation car, corresponding to a hall call which is not allocated, in proportion with an allocation suitability of each allocation candidate car.

4. The group management control method of claim 3, wherein the generation of an initial genetic sample comprises a stage for generating a gene so that a car previously allocated to a hall call of a certain floor can be temporarily allocated to an estimate hall call of a floor which is adjacent to the certain floor.

5. The group management control method of claim 4, wherein the stage comprises reducing a number of genes by temporarily allocating a same car, which is allocated to a hall call of a certain floor, to estimate hall calls of floors which are adjacent to the certain floor to which the car is allocated, and changing a number of floors to be controlled according to a transport situation.

6. The group management control method of claim 1, wherein said step of applying comprises computing an estimate arrival time when generating a gene and excluding a car of which the estimate arrival time is more than a predetermined time from a genetic code.

7. The group management control method of claim 1, wherein said step of applying comprises evaluating a gene by applying expectation of an estimate arrival time and an evaluation function.

8. The group management control method of claim 1, wherein said step of applying comprises selecting a parent gene by a probability which is proportioned to a selection suitability of a gene.

9. The group management control method of claim 1, wherein said step of applying comprises allocating a car which corresponds to a non-allocated hall call by interpreting a gene having the highest evaluation value.

10. The group management control method of claim 1, wherein said step of applying comprises simplifying a genetic form by obtaining an estimate hall call of each section and computing the genetic algorithm.

11. The group management control method of claim 1, wherein said step of applying comprises generating a new gene by changing a genetic order or by inserting a new number arrangement into a gene of the parent gene.

12. The group management control method of claim 1, wherein said step of applying comprises allocating a gene which has a highest evaluation value by which operations of encoding an allocation type to a genetic type, generating a new gene by using the encoded genetic type, and again selecting a parent gene by selecting a gene having best evaluation value, wherein the allocation of a gene, the generation of a new gene and the selecting of a parent gene are repeatedly performed a predetermined number of times.

13. The group management control method of claim 1, wherein said step of applying comprises obtaining expectation of an estimate arrival time by considering an estimate arrival time applied to evaluate a gene with respect to a future hall call and considering all possibilities.

14. The group management control method of claim 1, wherein said step of applying comprises obtaining each weight of an estimate hall call generation probability by considering current location and direction of each car and of an estimate hall call generation probability by each floor and direction, and adding a weight to an estimate hall call.

15. An elevator group management controller comprising:

a unit for receiving a passenger hall call;

a hall call determiner for computing a number of future hall calls that will be generated in each of predetermined sections of a building;

a probability generator for obtaining future hall call generation probability based on the computed number of hall calls and for determining floor and direction for which a hall call is generated in accordance with the obtained generation probability;

an evaluator for generating an evaluation value of each car for responding to the passenger hall call using a synthetic function in accordance with the computed number of future hall calls; and a selector for selecting a plurality of cars having highest evaluation values as allocation candidate cars for the passenger hall call and for selecting one of the allocation candidate cars as an optimum car for the passenger hall call, the optimum car being selected in accordance with a genetic algorithm and the determined floor and direction.

16. The elevator group management controller of claim 15, wherein said probability generator obtains the generation probability based also on an estimate number of passengers.

17. The elevator group management controller of claim 15, wherein more than two cars having high evaluation values are selected as allocation candidate cars by said selector.

18. A method of elevator group management control comprising:

receiving a passenger hall call;

computing a number of future hall calls that will be generated in each of predetermined sections of a building;

obtaining future hall call generation probability based on computed number of hall calls;

determining floor and direction for which a hall call is generated in accordance with the obtained generation probability;

generating an evaluation value of each car for responding to the passenger hall call using a synthetic function in accordance with the computed number of future hall calls;

selecting a plurality of cars having highest evaluation values as allocation candidate cars for the passenger hall call; and selecting one of the allocation candidate cars as an optimum car for the passenger hall call in accordance with a genetic algorithm and the determined floor and direction.

19. The method of elevator group management control of claim 18, wherein said step of obtaining generation probability is also based on an estimate number of passengers.

20. The method of elevator group management control of claim 18, wherein more than two cars having highest evaluation values are selected as allocation candidate cars.

* * * * *